United States Patent [19]

Satake et al.

[11] 4,066,012

[45] Jan. 3, 1978

[54] ROLL TYPE HULLER

[75] Inventors: Toshihiko Satake; Akira Kono; Hiromichi Yanagihara, all of Higashihiroshima, Japan

[73] Assignee: Satake Engineering Co., Ltd., Tokyo, Japan

[21] Appl. No.: 667,166

[22] Filed: Mar. 15, 1976

[30] Foreign Application Priority Data

June 2, 1975 Japan ..... 50-66877

[51] Int. Cl.[2] ..... B02B 3/04

[52] U.S. Cl. ..... 99/618; 99/620; 99/621; 99/622; 130/30 H

[58] Field of Search ..... 99/618-622, 99/574, 579; 130/30 H; 254/175.3

[56] References Cited

U.S. PATENT DOCUMENTS 3,104,692 9/1963 Davis et al. ..... 99/621 X

FOREIGN PATENT DOCUMENTS 1,772 of 1890 United Kingdom ..... 99/621

952,668 3/1964 United Kingdom ..... 99/619

*Primary Examiner*—Jay N. Eskovitz

*Attorney, Agent, or Firm*—Jay L. Chaskin

[57] ABSTRACT

A roll type huller including a housing, a pair of hulling rolls parallelly spaced apart within the housing, a main shaft carrying one of the rolls and supported by the housing rotatably about a fixed axis, and a counter shaft carrying the other roll and supported near the free end of an arm mounted at the base by a pivot which is spaced from, and parallel with, the fixed axis, so that the counter shaft can move toward and away from the main shaft while maintaining the parallelism. The pivot is supported by the housing in a relative position opposite to the roll-carrying portion of the counter shaft. The location of the pivot may be inside the housing beneath the counter shaft or outside of the housing above the shaft or elsewhere provided the aforesaid relationship with the shaft is maintained.

5 Claims, 6 Drawing Figures

ROLL TYPE HULLER

This invention relates to a huller of the roll type, and more specifically to improvements in a roll type huller including a housing, a pair of rolls parallelly spaced apart within the housing, a main shaft carrying one of the rolls and supported rotatably about a fixed axis inside the housing, and a counter shaft carrying the other roll and supported in the vicinity of the free end of an arm mounted at the base by a pivot which is apart from, and parallel with, the said fixed axis, so that the counter shaft can move toward and away from the main shaft while in parallel therewith.

With the prior art hullers of the roll type, it has been customary that the pivot of the arm mounted on the counter shaft is supported by an extension of the housing in a location opposite to the portion of the counter shaft extending out of the housing that consistutes a hulling chamber. This construction has necessitated a very long counter shaft and therefore a housing of great axial or longitudinal dimensions. In addition, the span of bearing means for mounting the pivot is not adequate for the bending moment in the inner end portion of the counter shaft on which the roll is mounted, with frequent lack of parallelism of the counter shaft with the main shaft. This has been a major cause for low hulling efficiencies of the conventional machines.

The present invention is directed to improvements in the roll type huller of the character described so that the parallelism or uniformity of the roller gap during the hulling operation, an essential factor for the satisfactory huller performance, can be ensured and the overall lengths of the main and counter shafts are decreased with consequent reductions in the longitudinal dimensions of the huller.

According to this invention, a roll type huller is provided which includes a housing, a pair of hulling rolls spaced apart in parallel within the housing, a main shaft carrying one of the rolls and supported by the housing rotatably about a fixed axis, and a counter shaft carrying the other roll and supported in the vicinity of the free end of an arm mounted at the base by a pivot which is apart from, and parallel with, the said fixed axis in such a manner that the counter shaft can move toward and away from the main shaft while in parallel therewith, wherein said pivot is supported by the housing in a relative location opposite to the roll-carrying portion of the counter shaft.

With the foregoing construction the huller of the invention provides an adequate span for the bearing means of the arm-supporting pivot and, because the structure of the counter shaft, arm, and pivot assembly is robust enough to maintain the parallelism of the counter shaft with the main shaft regardless of the displacement of the former with respect to the latter, the roll gap is kept uniform across the entire width of the rolls and a maximum hulling performance is attained for a long period. Furthermore, the total length of the counter shaft is decreased and hence the longitudinal dimensions of the huller can be reduced.

The above and other objects and advantages of the invention will become more apparent from the following description taken in connection with the accompanying drawings, wherein.

Figure 1:
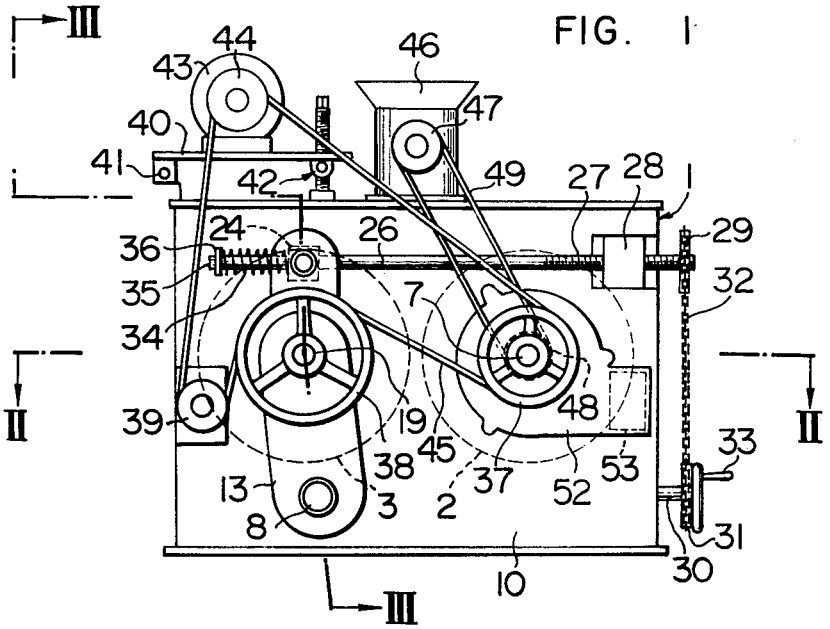
FIG. 1 is a front view of an embodiment of the invention.
Figure 2:
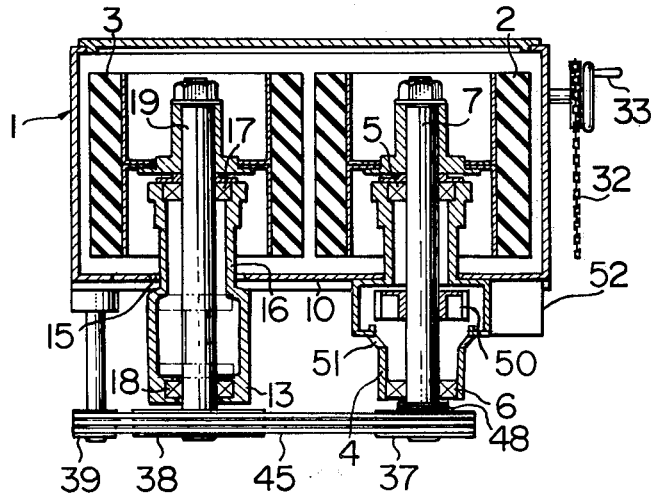
FIG. 2 is a sectional view taken on the line II—II of FIG. 1.
Figure 3:
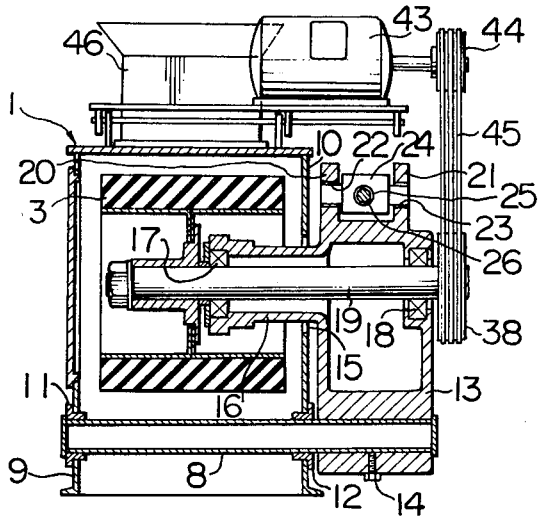
FIG. 3 is a sectional view taken on the line III—III of FIG. 1.

Referring now to FIGS. 1 to 3, there is shown a housing 1 accommodating a pair of hulling rubber rolls 2, 3 in a parallel arrangement. The rubber roll 2 is rotatably mounted on a main shaft 7, which in turn is supported for rotation about a fixed axis by a pair of bearings 5, 6 in a shaft housing 4 secured to the machine housing 1. As shown in FIG. 3, a pivot 8 is supported in the lower part of the machine housing 1 by bearings 11, 12 provided, respectively, in the rear wall 9 and the front wall 10 of the housing, so that this pivot rotates in parallel with the said fixed axis (that of the main shaft). The pivot 8 extends frontwardly through the front wall 10 and carries on the exposed end portion an arm 13, which is secured at the base to the pivot by a setscrew 14 and is turnable therewith. The free end portion of the arm 13 includes a shaft housing 16 which extends at a right angle to the free end and inwardly of the machine housing through an opening 15 in the front wall 10. A bearing 17 provided in this shaft housing 16 coacts with a bearing 18 in the frontal portion of the arm 13 to support a counter shaft 19 in such a manner that the shaft rotates with the rubber roll 3 thereon in parallel with the main shaft 7. Since the shaft housing of the arm 13 extending inwardly of the opening 15 is reduced in diameter as best shown in FIG. 2, the arm can swing within a certain angular range about the axis of the pivot 8 as the fulcrum. Accordingly the counter shaft 19 can be shifted toward or away from the main shaft 7 while remaining parallel therewith. This arrangement permits the gap between the rubber rolls 2, 3 on the main and counter shafts to be adjusted by a mechanism which is described below. In order to establish airtightness between the opening 15 and the shaft housing 16 extended from the arm, suitable seal means (not shown), for example of a sliding type, is provided.

As illustrated in FIG. 3, a pair of upright ears 20, 21 are formed parallelly in spaced relation on the upper end of the arm 13, at right angles to the axis of the counter shaft 19. The ears 20, 21 have opposing lateral holes 22, 23, respectively, which receive pins at both ends of a slide 24, so that the slide can be movably supported between the ears. The slide 24 is formed with a center hole 25, through which a threaded rod 26 for forcing the counter shaft toward or away from the main shaft extends freely in parallel with the front wall of the machine housing 1. The rod 26 is threaded at one end portion 27 as shown in FIG. 1, and this threaded portion 27 is engaged with a nut (not shown) held with a spherical bearing (not shown) in a nut housing 28 fast on the front wall 10 of the housing 1. A sprocket 29 is attached to the outer extremity of the threaded portion and is connected to a sprocket 31 on a shaft 30 rotatably supported on the lower part of the housing 1 by means of an endless chain 32. The shaft 30 carries a handwheel 33 for manual rotation. The end portion opposite to the threaded one of the rod 26 is surrounded by a coiled spring 34. The outer end of the spring 34 is kept in contact with a spring bearing 36 fastened to the end of the rod by a nut 35, and the inner end of the spring in contact with one side of the slide 24. Since the axis of the pivot 8 always lies to the right of the slide 24 thereabove as viewed in FIG. 1, the combined weight of the arm 13, counter shaft 19, rubber roll 3, and the associated parts acts to keep the slide 24 in contact with the spring 34. The contact is further ensured by the tension of endless belts of a driving mechanism to be described later. Thus, if the handwheel 33 is turned to rotate the threaded rod 26, the rod will move axially in thread engagement with the stationary nut held in the nut housing. This axial movement, in turn, will enable the spring bearing 36, coiled spring 34, and slide 24 to move the arm 13 swingingly about the axis of the pivot 8 until the gap between the rubber rolls 2, 3 is adjusted to a desired value.

On the outer ends of the main shaft 7 and the counter shaft 19 are mounted grooved pulleys 37, 38, respectively. Also, at the front of the machine housing is provided an idle grooved pulley 39. A motor base 40 is secured at one end to the upper surface of the housing 1 by a hinge 41, the other end of the base being associated with a height adjuster 42 which is a combination of a threaded rod and a nut, so that the height of the other end of the motor base and therefore the position of the motor 43 fixed to the base can be adjusted as desired. A plurality of V belts 45 are extended, as shown in FIGS. 1 and 2, around a grooved pulley 44 on the motor, idle grooved pulley 39, and the grooved pulleys 37, 38 on the main and counter shafts so that, when the belts are driven, the rubber rolls 2, 3 can revolve in opposite directions. The tension of the V belts is adjusted by modifying the position of the motor base 40 by means of the height adjuster 46. In order to impart the necessary frictional forces to the grains that pass between the rubber rolls 2, 3 for hulling, it is important that the two rolls run at different circumferential speeds. In the embodiment being described, the grooved pulley 37 on the main shaft is smaller than the pulley 38 on the counter shaft and therefore the rubber roll 2 associated with the pulley 37 runs faster than the roll 3.

On top of the machine housing 1 is installed a grain feeder 46, which is driven by a V belt 49 applied around a pulley 47 of its own and an additional pulley 48 on the main shaft 7, to feed grains to the rubber rolls at an adequately controlled rate according to the rotation of the rolls.

Turning to FIG. 2, an impeller 50 for roll cooling is set on an intermediate part of the main shaft 7. Rotation of the shaft causes the impeller to draw air from an air inlet 51 formed in the shaft housing 4, supply the same to an air passage 52 shown in FIG. 1, and then, at the left end of the air passage, admit the air from an opening 53 in the front wall of the machine housing into the said housing to cool the rolls therein.

The operation of this embodiment of the invention will now be explained. First, the operator turns the handlwheel 33 and thereby adjusts the gap between the rubber rolls 2, 3 to suit the type and size of the grains to be hulled. Next, the huller is started and grains are fed from the feeder to the rubber rolls. As they pass downward through the rolls running in opposite directions, the grains are hulled by the frictional forces exerted by the difference in circumferential speed between the two rolls 2, 3 as well as by proper elastic forces resulting from the rubber-like elasticity of the rolls and the tensile strength of the threaded rod 26 being transmitted via the coiled spring 34. At this time the hulling pressure being applied in the roll gap produces a great bending moment in the bearing 17, which is intensified with an increase in the axial distance away from the bearing 17, and results in stresses tending to force the counter shaft 19 and the main shaft 7 curvedly away from each other. This problem is settled, in accordance with the present invention, since the pivot 8 is supported by the housing 1 with bearings 11, 12 provided with an adequate span at points corresponding to the roll-carrying portion of the counter shaft, so that the arm 13 is sufficiently robust in construction to maintain the parallelism between the main and counter shafts. Moreover, the length of the counter shaft 19 can be decreased and the overall axial dimensions of the huller reduced to provide a compact construction.

Figure 4:
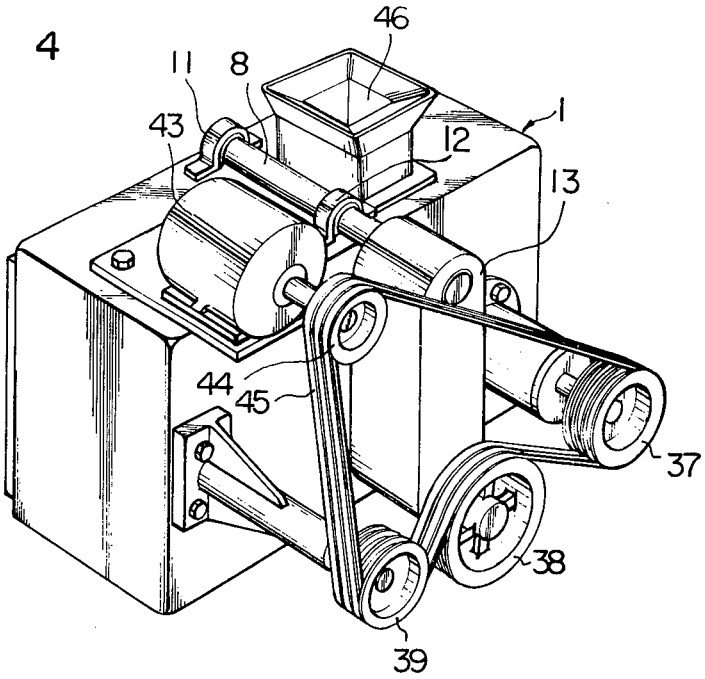
FIG. 4 is a perspective view of another embodiment of the invention.

Although, in the embodiment above described, the pivot 8 extends through the housing constituting the hulling chamber and is located opposite to the roll-carrying portion of the counter shaft, the location of the pivot is not limited thereto. In another embodiment shown in FIG. 4, the pivot 8 is supported by bearings 11, 12 atop the housing thus assuming an opposing positional relationship with the roll-carrying portion of the counter shaft via the top wall of the housing.

Figure 6:
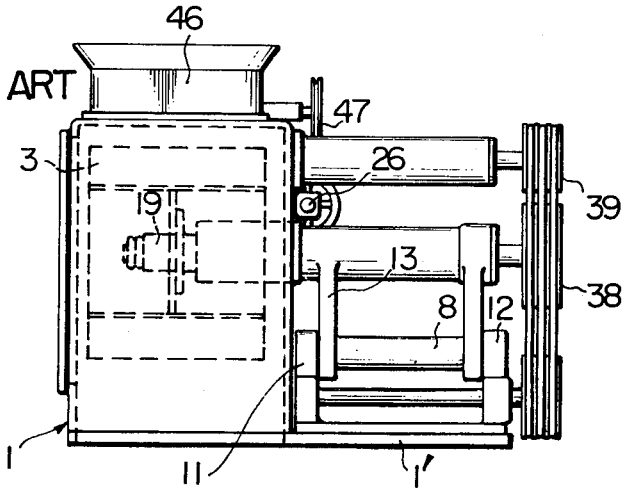
FIG. 6 PRIOR ART
FIG. 6 is a side view of the conventional machine shown in FIG. 5.
Figure 5:
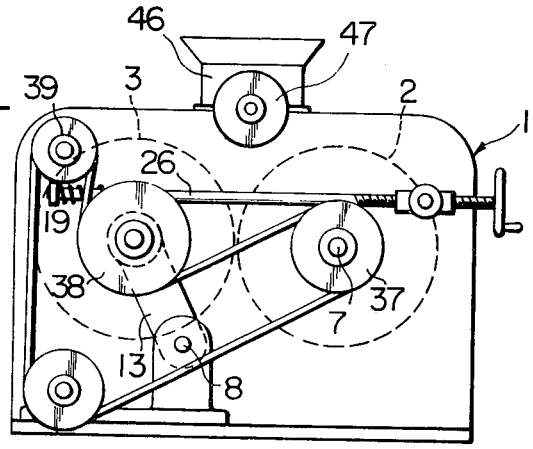
FIG. 5 PRIOR ART
FIG. 5 is a front view of a conventional huller.

FIGS. 5 and 6 illustrate a conventional huller, in which a main shaft 7 and a counter shaft 19 carry rubber rolls 2, 3, respectively, and the counter shaft 19 is supported at the outer end by an arm 13 based on a pivot 8 which, in turn, is supported by bearings 11, 12 on an extension 1′ of the housing 1, in a location opposite to the extension of the counter shaft 19 out of the housing 1 that constitutes a hulling chamber. Because of the construction described, the ratio of the length of the counter shaft portion carrying the rubber roll within the housing to the span between the bearings 11 and 12 of the pivot 8 is not adequate, and it is difficult to secure a parallelism with a proper strength between the main shaft 7 and the counter shaft 19. Thus, it will be readily understood by those skilled in the art that any attempt at obtaining the adequate strength by increasing the span between the hearings 11, 12 would involve further increases in the axial dimensions of the huller to a disadvantage.

Various modifications may be made in the present invention and specific embodiment, by one skilled in the art without departing from the scope of the invention as defined by the claims.

What is claimed is:

1. A roll type huller for removing grain hulls comprising a housing; a pair of rolls spaced apart in parallel within the housing; a main shaft carrying one of the rolls at one end portion thereof and supported by the housing rotatably about a fixed axis; a counter shaft carrying the other roll at one end portion thereof; pivot means spaced from and parallel to the fixed axis, the pivot means having an arm extending therefrom for supporting the counter shaft, the pivot means being supported by the housing in a relative location directly confronting the roll-carrying portion of the counter shaft whereby the counter shaft can move toward and away from the main shaft while in parallel therewith.

2. A roll type huller according to claim 1 wherein the housing has front and rear walls, the pivot means being supported by bearings located on the front and rear walls.

3. A roll type huller according to claim 1 wherein the arm supporting the counter shaft is located outside the housing.

4. A roll type huller according to claim 1 wherein at least a portion of the pivot means is located outside the housing.

5. A roll type huller according to claim 1 wherein the pivot means is located within the housing.

* * * * *